US005833116A

United States Patent [19]

Guillin

[11] Patent Number: 5,833,116

[45] Date of Patent: Nov. 10, 1998

[54] ANGULAR FASTENING DEVICE

[75] Inventor: François Guillin, Mouthier Haute Pierre, France

[73] Assignee: Groupe Guillin (S.A.), Ornans, France

[21] Appl. No.: 819,798

[22] Filed: Mar. 18, 1997

[30] Foreign Application Priority Data

Apr. 25, 1996 [EP] European Pat. Off. ..... 96440032

[51] Int. Cl.[6] ..... B65D 41/16

[52] U.S. Cl. ..... 220/783; 220/785; 220/788; 220/794; 220/366.1; 220/367.1

[58] Field of Search ..... 220/781, 782, 220/783, 784, 785, 786, 788, 794, 366.1, 367.1

[56] References Cited

U.S. PATENT DOCUMENTS

| | | | |
|---|---|---|---|
| 2,914,104 | 11/1959 | Jocelyn | 220/783 |
| 3,675,811 | 7/1972 | Artz | 220/784 X |
| 3,912,118 | 10/1975 | Bird | 220/782 X |
| 4,206,845 | 6/1980 | Christian | 206/508 |
| 4,390,113 | 6/1983 | Bird | 220/366.1 X |
| 4,741,452 | 5/1988 | Holzkopf | 220/783 |
| 5,287,959 | 2/1994 | Hansen et al. | 220/783 X |

*Primary Examiner*—Stephen K. Cronin
*Attorney, Agent, or Firm*—Abelman, Frayne & Schwab

[57] ABSTRACT

Package for the packaging of food products composed of two elements, a base (1) and a lid (2), each having a peripheral edge whose respective outlines enable lateral slots (3) to exist in the position of closure of the said lid (2) of the said package having localised closure means in the angular areas (F1) to (F4) of the package and situated in the vicinity of the external edge 10 of one of the elements and cooperating in the said angular areas (F1) to (F4) with the peripheral rim of the other element, characterised in that the said closure means take the form of grooves (11) having, level with the said angular areas (F1) to (F4), an external vertical rim, and then a lower horizontal portion forming a platform (13) directed towards the inside of the package, which is limited in the direction of the centre by a vertical partition (14) connected to the wall (15) of the element in which the said means are formed.

10 Claims, 4 Drawing Sheets

ANGULAR FASTENING DEVICE

FIELD OF THE INVENTION

The present invention concerns a package for the packaging of food products of the type having ventilation slots between the base and the lid of the said package.

DESCRIPTION OF THE RELATED ART

The existence of these slots, when they are located on all four faces, imposes a particular structure on the closure system, since the said slots are generally produced between the base and the lid, by means of a particular outline of one or the other of these elements.

The functional areas for closure are consequently limited, necessitating a particular design intended to confer on the said closure mechanical characteristics adapted to the use of the said packages. In particular, it is desirable for handling to be easy, but for the closure to be secure despite its limited application surface.

When the four faces are provided with slots, as is the case in the package of the invention, the closure system is distributed in the corners, in the four angular areas. It is then necessary to reach a compromise between the size of the said ventilation slots, whose functional efficacy is obviously proportional to the size, and the size/design of each angular closure mechanism.

Most food packaging containers known to date have slots only on three sides, the fourth being occupied by a hinge which considerably simplifies the problem of designing closure systems positioned on the opposite face. In general, this involves studs cooperating with housings whose outer rim permits tight engagement with the said studs.

Hinged packages do, however, have drawbacks, amongst them for example the fact that they are inconvenient to stack, since it is preferably necessary to stack the body, and poorly stacked lids take up considerable space. This type of package is, moreover, used for particular applications, not affected by the package of the invention, whose lid is fully removable, and has four lateral slots which therefore calls for a dedicated closure system.

The latter has, furthermore, been so designed as to enable the closure between the base and the cover to be optimised, whatever the degree of mechanisation of this operation.

A system which applies to packages with two separate elements, each having a peripheral edge whose respective outlines enable lateral slots to exist in the position of closure of the said lid and which has localised closure means in the angular areas of the package, situated in the vicinity of the external rim of one of the elements and cooperating in the said angular areas with the peripheral rim of the other element, was described in GB-A-2 200 340.

SUMMARY OF THE INVENTION

The present invention is characterised by the fact that these closure means take the appearance of grooves and that the said closure means in the form of grooves have level with the said angular areas an external vertical rim, and then a lower horizontal portion forming a platform directed towards the inside of the package, which is limited in the direction of the centre by a vertical partition connected to the wall of the element in which the said means are formed.

The existence of these grooves in fact makes it possible to produce a closure which may be classed as internal, which facilitates both manual lid application and automated lid fitting. The fact that the lid, for example, can be inserted in the base enables it to be made more rigid than in configurations in which the lid fits on the base on the outside. It is this rigidity which facilitates the use of automation processes, as well as manual handling, and makes it easier to establish a connection between the two elements.

There are therefore three distinct portions forming a female configuration of the groove type, namely an external vertical portion forming the external rim, a horizontal portion forming the platform and a portion, also vertical, forming the partition, itself directly linked to the package wall.

In order to provide for locking, the closure means also include, between the external edge and the horizontal platform, a horizontal undercut, situated substantially level with the upper part of the said partition, and limiting over its entire length the upper opening of the said groove.

The grooves thus formed are therefore limited to the four angular areas, where they run along the external rim of the element in which they are formed. They cooperate with special profiles created in the second element, so as to provide for simple, efficacious fixing of the lid on the base.

According to the invention, the peripheral edge of the second element forming the package has in the angular areas a flat surface designed to rest upon the said horizontal portion forming a platform in the aforementioned groove.

More specifically, the said flat surface is limited on the one hand towards the outside by an external rim designed to be housed between the platform and the undercut, and on the other hand by the wall of the said second element, whose orientation enables it to come into contact with the said partition.

Cooperation between the two elements is, in fact, brought about by snapping one into the other, the peripheral edge of one being adapted to the other dimensionally, that is to say horizontally and vertically.

Preferably, the closure means taking the form of grooves are situated on the base of the package.

Also preferably, the ventilation slots are provided in the outline of the rim of the lid.

This special configuration facilitates the automation of the fitting of lids, as mentioned before.

However, this constitutes a preferential structure which can be modified. There is nothing to prevent an outline of the edges of the base being produced which enables the slots to be included therein, or indeed outlines being produced which have similar slots facing each other in the base and in the lid at the same time.

Furthermore, it is possible to produce the female closure means (that is to say the grooves) in the edge of the lid, while the profile adapted thereto is formed on the base.

These possibilities, combined with those concerning the existence and location of the slots, result in a wide range of shapes for the packages according to the invention.

Of course, in order for the snapping-in to function correctly, it is necessary for the profile of the male-type rim to be provided with a degree of elasticity, enabling it to be inserted into the locking undercut.

The partition forming the groove towards the inside of the casing is necessary in order to prevent any relative stray movement of the lid with respect to the base when a vertical pressure is exerted on the said lid. Thus, while most closure systems of this type of package require no vertical structure similar to the said internal partition, owing to the existence of the closure mechanism over the whole periphery, this type of package requires this solution since the lid is able to deform inwards between the angular bearing areas.

The existence of the four slots therefore raised a particular technical problem, resolved by the original solution of the invention, notably but exclusively integrating the said partition, and associating it with the horizontal undercut to form a locking of limited length. In the case of a rigid lid, this configuration affords useful guidance in the mechanisation of lid fitting.

The invention will now be described in greater detail, by means of the accompanying figures, for which:

DETAILED DESCRIPTION

Figure 1:
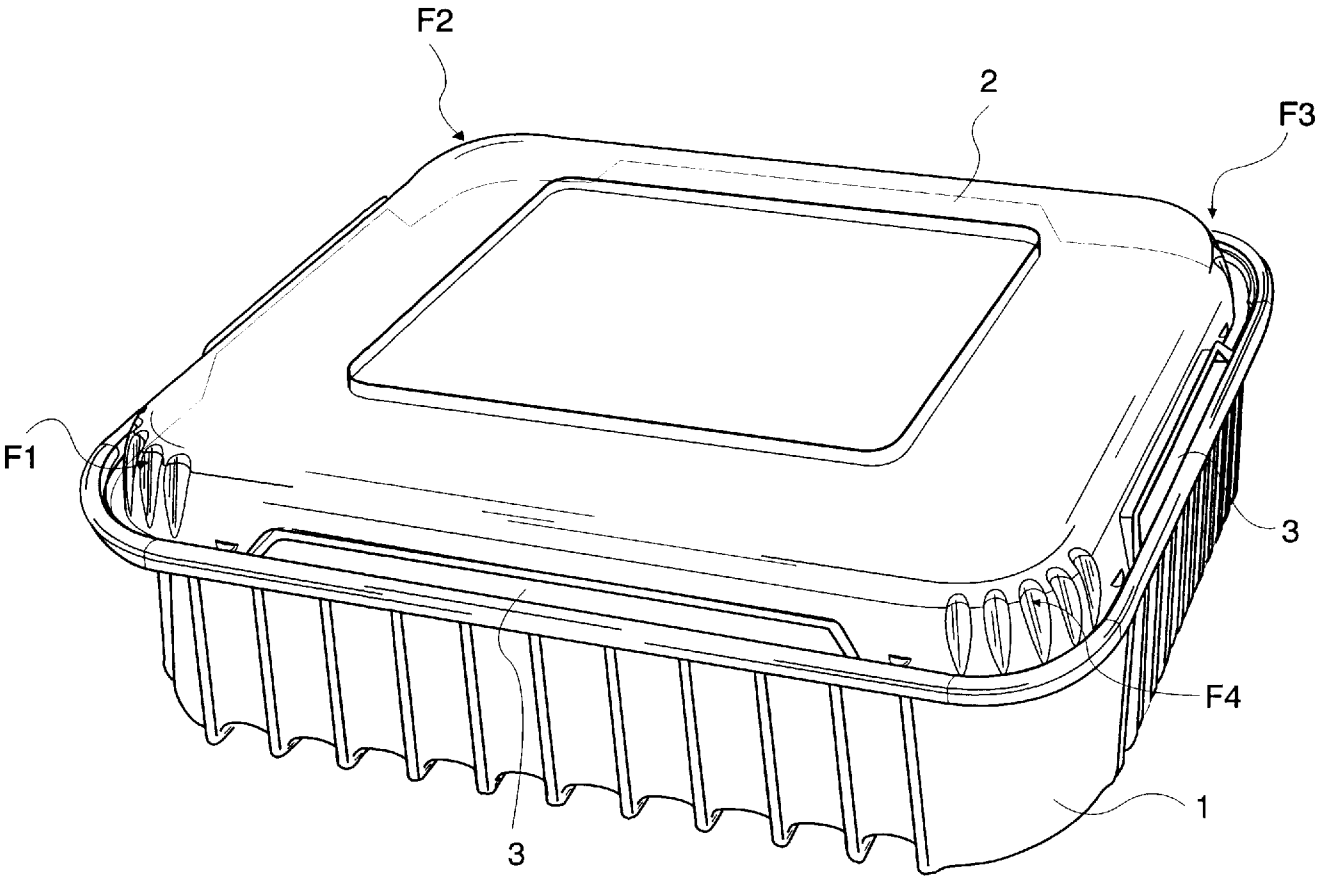
FIG. 1 is a perspective view of the whole package of the invention.

Referring now to FIG. 1, the package of the invention is composed of a base 1 and a lid 2. The latter is provided with lateral slots 3 permitting ventilation.

This view shows particularly clearly the four angular closure areas F1, F2, F3 and F4, which border on each lateral slot 3 in twos.

Figure 2:
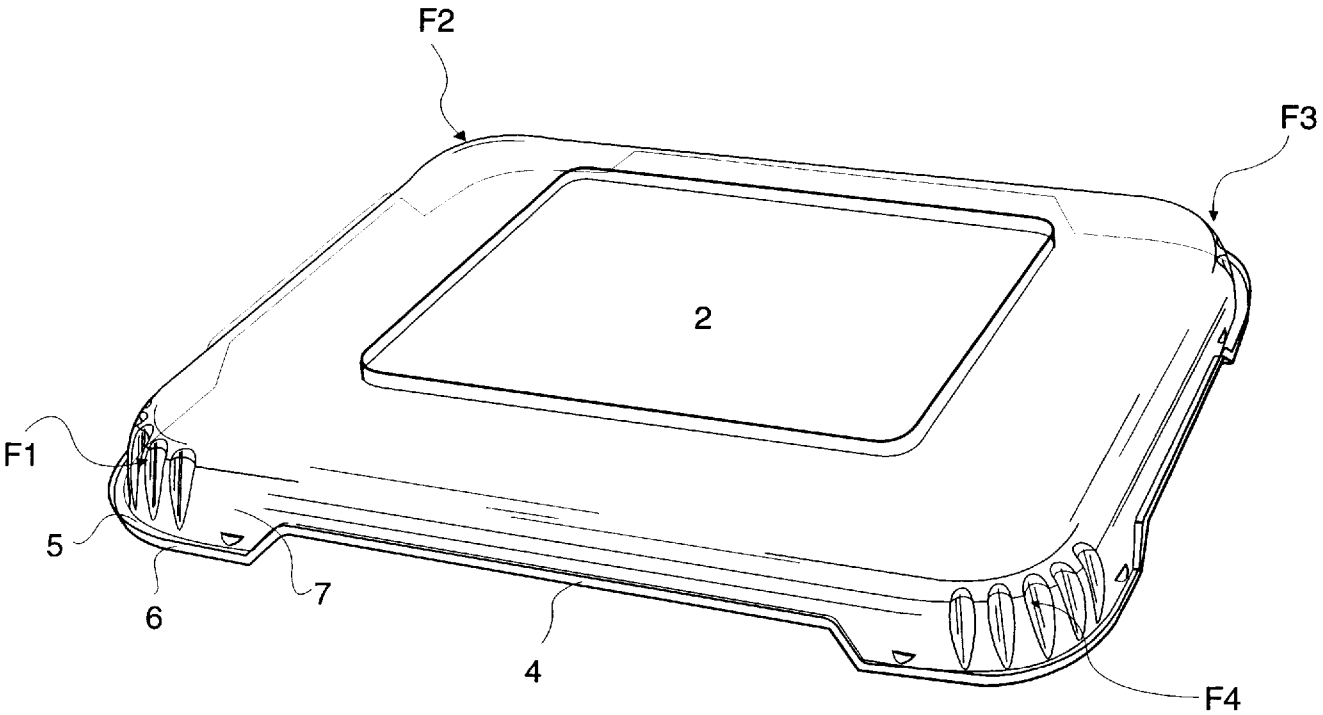
FIG. 2 is a perspective view of the lid on its own.

FIG. 2 depicts in an even more detailed manner the configuration of the lid 2, in which the said slots 3 are formed, without the base 1.

This lid has a peripheral edge 4 which runs along the whole periphery, including the said areas F1 to F4. However, only the latter areas perform a function in the closure. On the part F1there appears the flat surface 5 limited towards the outside by a rim 6 which rises in a direction substantially parallel to the wall 7 of the lid.

Figure 3:
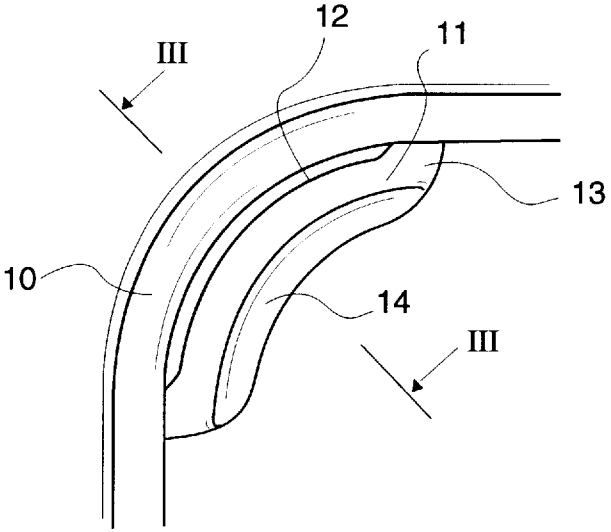
FIG. 3 depicts a plan view of an enlarged angular area of the base.
Figure 5:
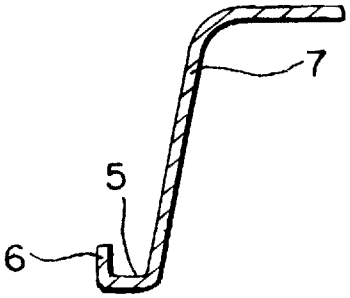
FIG. 5 is a cross section of the lid, in the direction of the same arrows III—III in FIG. 3.

This view is complemented by that of FIG. 5, which shows a diagonal transverse cross section in the direction of the arrows III—III in FIG. 3. The length of the edge 6 is determined so as to cooperate with the corresponding vertical portion of the base 1. Similarly, the width of the surface 5 corresponds substantially to that of the groove.

Figure 4:
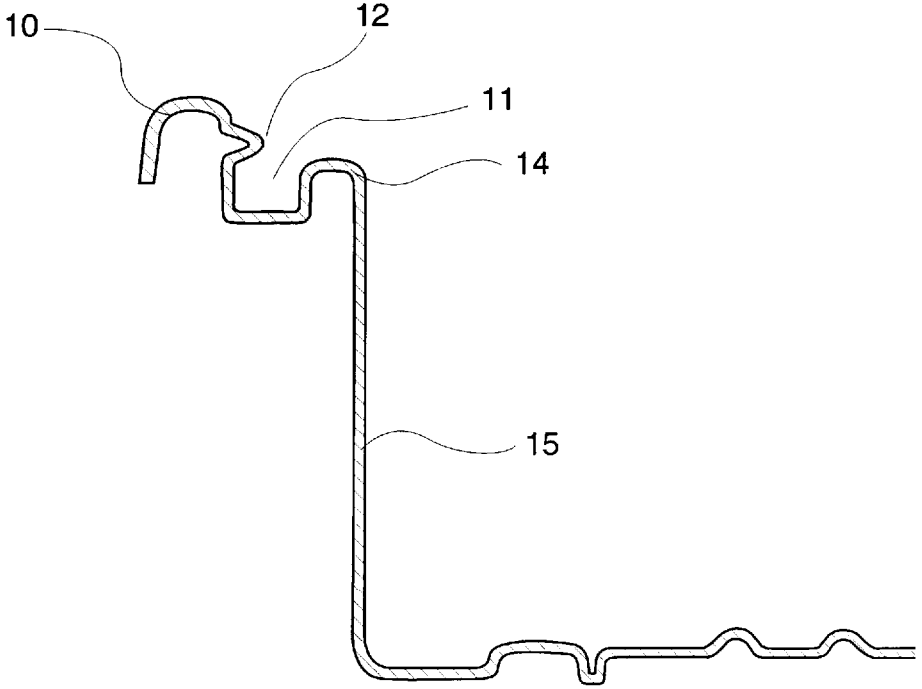
FIG. 4 is a cross section of the base, produced level with the arrows III—III in the preceding view.

The latter appears in greater detail in FIGS. 3 and 4. The peripheral end 10 has a horizontal portion contiguous with an external vertical portion, and does not play any role in the closure mechanism proper. However, it can serve as a support for the user during the opening operation.

Between this peripheral area 10 and the groove 11 there is the undercut 12 which hangs over the horizontal platform 13 and faces the partition 14. The latter is connected to the wall 15 of the base.

Figure 6:
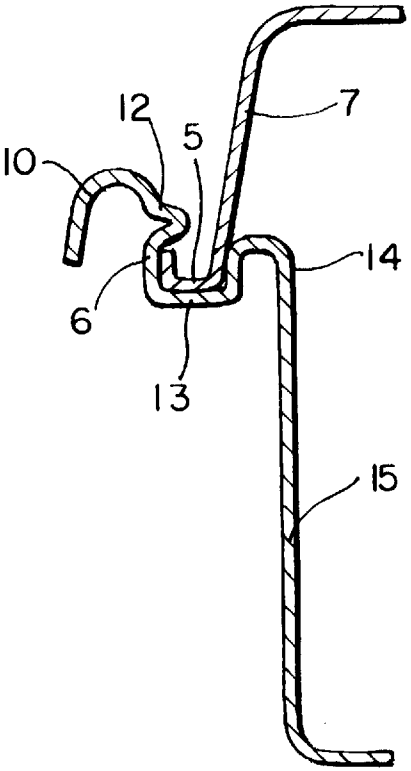
FIG. 6 shows the fixing of the closure means associated with the lid in the closure means associated with the base.

When the connection is effected, with the lid 2 in the closed position on the base, as depicted in FIG. 6, the horizontal surfaces 5 and 13 are in contact with each other, and the surface 6 is in contact with the vertical wall of the groove 11 under the locking undercut 12, and the wall 7 of the lid 2 is in contact with the partition 14.

The assembly is locked, and a simple vertical pressure is not sufficient to modify the connection, nor is it sufficient to pull one element in order to move it away from the other.

Whereas in order to close, by virtue of the flexibility and elasticity of the rims 6 of each area F1 to F4 of the lid 2, it is sufficient to push the lid with a slight vertical force towards the bottom, the opening operation is more complex, owing to the locking exerted by the undercuts 12 at the four corners.

It is in fact necessary to exert a separation force applied for example in a lateral slot 3, aimed at separating the two elements from each other, to free the two closure systems situated at the two ends of the said slot 3. The elasticity of the external rims 6 is thus preferentially exploited once again. Then, the closure mechanisms of the opposite face offer hardly any resistance, since it is possible to exert a rotation of the lid, about an axis passing through the grooves in this face.

As has been said previously, the above configuration is not to be taken as a non-limitative example of the invention, of which variants falling within the scope of the accompanying claims have been cited.

I claim:

1. Package for the packaging of food products comprising:

a base (1) and a lid (2), said base and lid being separable to an open condition and including cooperating peripheral edges for contact engagement along spaced corner portions (F1 to F4) thereof to define a closed condition, the peripheral engagement between said base and said lid in said closed condition including openings therebetween to define a plurality of lateral ventilation slots (3) along said peripheral engagement, said lateral slots collectively existing along the major extent of said peripheral engagement, such that the spaced corner portion contact engagements between the peripheral edges of said base and top are collectively limited to a minor portion of their peripheral engagement;

closing means for effecting closure of the package at the locations of said spaced corner portions characterised in that:

said closing means includes a groove (11) on said base at the location of each of said corners (F1) to (F4), said groove including an external vertical rim, and then a lower horizontal portion forming a horizontal platform (13) extending towards the center of the package, said platform being limited inwardly by a vertical partition (14) connected to the side wall (15) of said base.

2. Package for the packaging of food products according to claim 1 (1), characterised in that said closing means is in the form of grooves (11) situated on the base (1) of the package.

3. Package for the packaging of food products according to claim 1, characterised in that said ventilation slots (3) are provided along the periphery of the rim (4) of the lid (2).

4. Package for the packaging of food products according to claim 1, characterised in that said closing means includes, between the external edge (10) of said base and said horizontal platform (13), a horizontal undercut (12), situated substantially level with the upper part of said vertical partition (14), and limiting over its entire length the upper opening of said groove (11).

5. Package for the packaging of food products according to claim 4, characterised in that the peripheral edge (4) of said lid has in the corner portions (F1) to (F4) a flat surface (5) designed to rest on said base upon said horizontal platform (13) in said groove (11).

6. Package for the packaging of food products according to claim 5, characterised in that the said flat surface (5)

includes inner and outer ends, said outer end limited by a vertical rim (6) said vertical rim designed to be housed between said platform (13) and said undercut (12), the inner end of said flat surface forming a juncture with the wall (7) of said lid which is operatively oriented to come into contact with the said partition (14) of said base.

7. Package for the packaging of food products according to claim 1, characterised in that the peripheral edge (4) of said lid has in the corner portions (F1) to (F4) a flat surface (5) designed to rest on said base upon the said horizontal platform (13) in said groove (11).

8. Package for the packaging of food products according to claim 7, characterised in that the said flat surface (5) includes inner and outer ends, said outer end limited by a vertical rim (6) said vertical rim designed to be housed between said platform (13) and said undercut (12), the inner end of said flat surface forming a juncture with the wall (7) of said lid which is operatively oriented to come into contact with the said partition (14) of said base.

9. Package for the packaging of food products according to claim 8 characterised in that said closing means is in the form of grooves (11) situated on the base (1) of the package.

10. Package for the packaging of food products according to claim 9, characterised in that said ventilation slots (3) are provided along the periphery of the rim (4) of the lid (2).

* * * * *